US006384531B1

(12) United States Patent
Park et al.

(10) Patent No.: US 6,384,531 B1
(45) Date of Patent: May 7, 2002

(54) PLASMA DISPLAY DEVICE WITH CONDUCTIVE METAL ELECTRODES AND AUXILIARY ELECTRODES

(75) Inventors: Deuk-il Park, Chonan; Joong-woo Nam, Suwon; Seung-pil Mun, Chonan, all of (KR)

(73) Assignee: Samsung Display Devices Co., Ltd., Kyungki-do (KR)

( * ) Notice: Subject to any disclaimer, the term of this patent is extended or adjusted under 35 U.S.C. 154(b) by 0 days.

(21) Appl. No.: 09/417,490

(22) Filed: Oct. 13, 1999

(30) Foreign Application Priority Data

Oct. 14, 1998 (KR) ..... 98-42927

(51) Int. Cl.[7] ..... H01J 17/49
(52) U.S. Cl. ..... 313/584; 313/582
(58) Field of Search ..... 313/584, 582, 313/583, 585, 586, 491, 492

(56) References Cited

U.S. PATENT DOCUMENTS 5,243,252 A * 9/1993 Kaneko et al. ..... 313/309
5,640,068 A * 6/1997 Amemiya ..... 313/582
6,008,580 A * 12/1999 Nakamura et al. ..... 313/568
6,051,923 A * 4/2000 Pong ..... 313/495
6,157,354 A * 12/2000 Amemiya ..... 345/60

* cited by examiner

*Primary Examiner*—Vip Patel
*Assistant Examiner*—Kenneth A Berck
(74) *Attorney, Agent, or Firm*—Lowe Hauptman Gilman & Berner, LLP

(57) ABSTRACT

A plasma display device including front and rear substrate disposed parallel to and facing each other, first electrodes formed in strips on the rear substrate, second and third electrodes formed of a conductive metal in strips on the lower surface of the front substrate so as to be perpendicular to the first electrodes, and at least one auxiliary electrode formed adjacent to the second and third electrodes.

19 Claims, 5 Drawing Sheets

PLASMA DISPLAY DEVICE WITH CONDUCTIVE METAL ELECTRODES AND AUXILIARY ELECTRODES

BACKGROUND OF THE INVENTION

1. Field of the Invention

The present invention relates to a plasma display device, and more particularly, to a plasma display device having an improved structure by forming an electrode formed on a transparent front substrate using a conductive metal.

2. Description of the Related Art

A plasma display device forms a picture image by discharging a gas sealed between opposing substrates having a plurality of electrodes and exciting a phosphor by ultraviolet rays generated during the discharge.

The plasma display device is classified into a direct current (DC) plasma display device and an alternating current (AC) plasma display device depending on its discharge types. Also, the plasma display device is largely classified into an opposing discharge type and a surface discharge type depending on its electrode structure.

In the DC plasma display device, all electrodes are exposed to a discharge space, and charges move directly between the electrodes. In the AC plasma display device, at least one electrode is surrounded by a dielectric layer and a discharge occurs due to an electrical field of wall charges.

FIGS. 1 and 2 show an example of a conventional surface discharge type plasma display device.

Referring to the drawing, first electrodes 11 as an address electrode are formed in strips on a rear substrate 10. A dielectric layer 12 formed on the rear substrate 10 is coated on the first electrode 11. Partitions 13 for defining a discharge space and preventing electrical and optical crosstalk between neighboring discharge cells are formed on the dielectric layer 12 so as to be parallel to the first electrode 11.

A front substrate 16 is coupled above the partition 13. On the lower surface of the front substrate 16, second electrodes 14 as scanning electrodes and third electrodes 15 as common electrodes are alternately formed to be perpendicular to the first electrodes 11 The second and third electrodes 14 and 15 are formed of transparent materials, and bus electrodes 14*a* and 15*a* for reducing line resistance of the second and third electrodes 14 and 15 are respectively provided thereon.

Also, on the lower surface of the front substrate 16, a dielectric layer 17 and a protective layer 18 are sequentially formed so that the second and third electrodes 14 and 15 are buried therein. A fluorescent layer 19 is coated at at least one side of the discharge space defined by the partitions 13.

In the plasma display device thus constructed, since the second and third electrodes 14 and 15 are formed of transparent ITO, an ITO film forming and patterning processes are necessary. ITO, however the conductivity is rather poor so that the operating voltage level must be high. One conventional way to solve the problem of poor conductivity is to form bus electrodes 14*a* and 15*a* on top of the second and third electrodes made of transparent ITO. Forming a bus electrode makes the PDP manufacturing process more complicated, thus increasing the cost. As an alternative, U.S. Pat. No. 5,640,078 (Amemiya) discloses ITO-electrodes having protrusions at every emitting pixel in order to decrease the amount of current flowing in the electrodes. However, prior art PDPs using ITO-based electrodes have not been able to fully overcome their inherent poor conductivity problem, and as a result, there is a problem in that power consumption is high, which is a major drawback in PDPs, in addition to the problem of high costs for the ITO material.

SUMMARY OF THE INVENTION

To solve the above problems, it is an object of the present invention to provide a plasma display device with an improved structure, capable of obviating the need for transparent electrodes.

Accordingly, to achieve the above object, there is provided a plasma display device including front and rear substrate disposed parallel to and facing each other, first electrodes formed in strips on the rear substrate, second and third electrodes formed of a conductive metal in strips on the lower surface of the front substrate so as to be perpendicular to the first electrodes, and at least one auxiliary electrode formed adjacent to the second and third electrodes.

Here, the auxiliary electrode is formed of a conductive metal.

According to another aspect of the present invention, there is provided a plasma display device including front and rear substrate disposed parallel to and facing each other, first electrodes formed in strips on the rear substrate, second and third electrodes formed of a conductive metal in strips on the lower surface of the front substrate so as to be perpendicular to the first electrodes, and auxiliary electrode portions extending from at least one of the second and third electrodes and formed therebetween.

BRIEF DESCRIPTION OF THE DRAWINGS

The above object and advantages of the present invention will become more apparent by describing in detail a preferred embodiment thereof with reference to the attached drawings in which.

DESCRIPTION OF THE PREFERRED EMBODIMENTS

In the plasma display device according to the present invention, second and third electrodes where a main discharge occurs are formed of a conductive metal.

Figure 1:
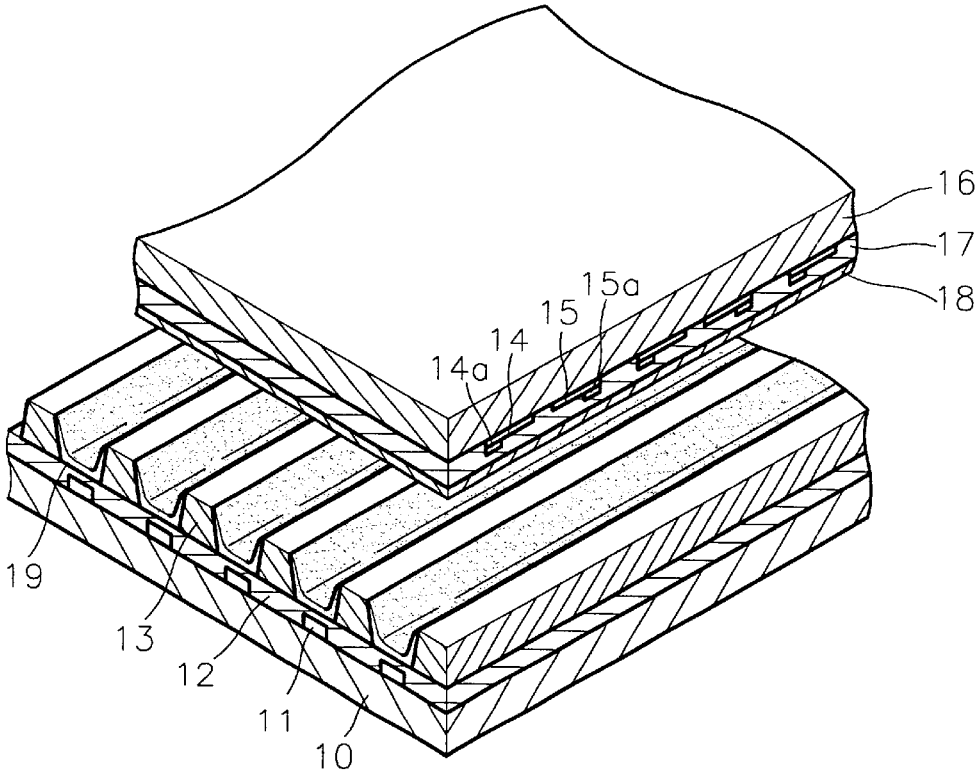
FIG. 1 (PRIOR ART)
FIG. 1 is an exploded perspective view of a conventional plasma display device.
Figure 2:
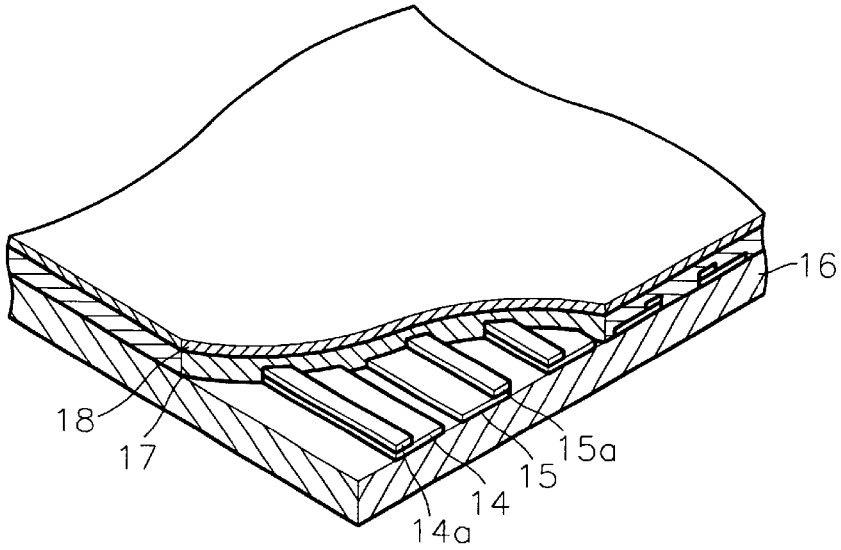
FIG. 2 (PRIOR ART)
FIG. 2 is a bottom view of a front substrate shown in FIG. 1.
Figure 3A:
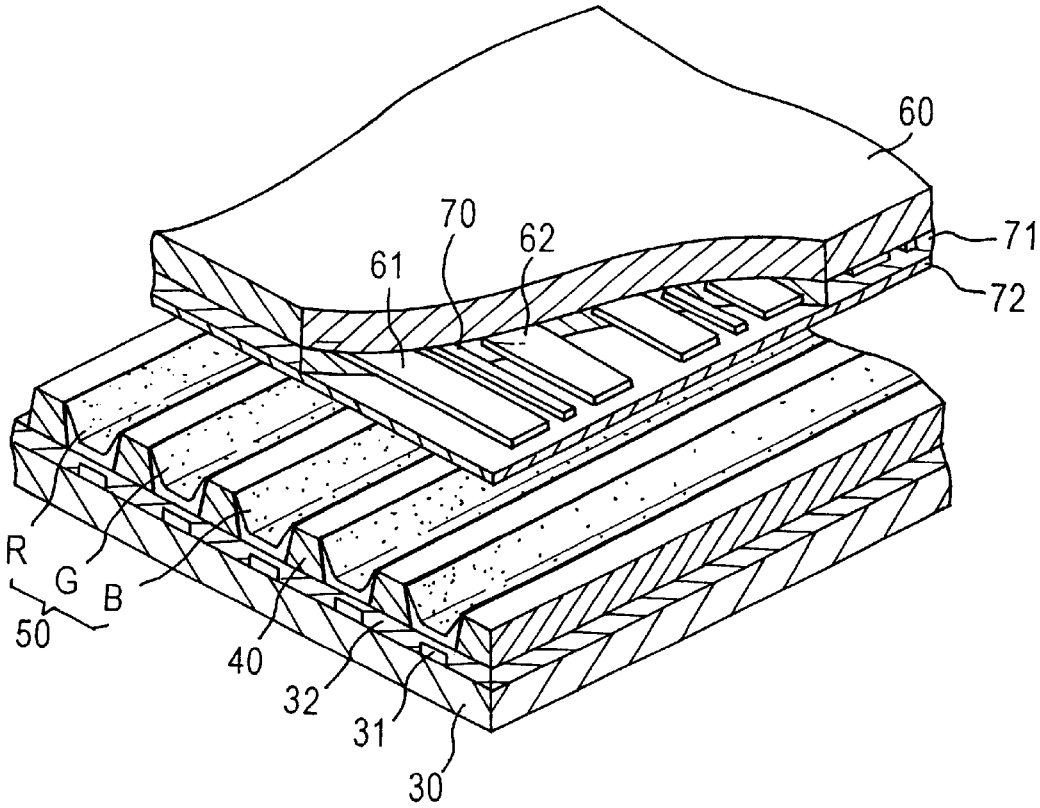
FIG. 3A is an exploded perspective view of a plasma display device according to an embodiment of the present invention.
Figure 3B:
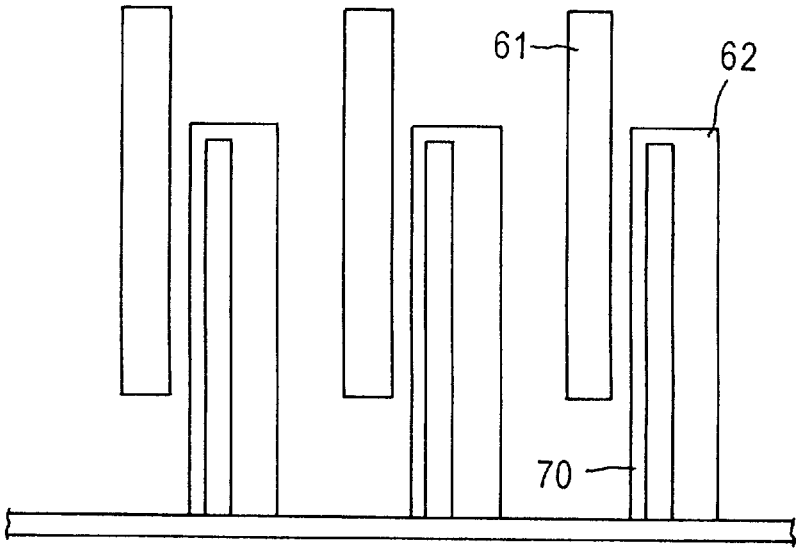
FIG. 3B is a plan view of second and third electrodes and an auxiliary electrode shown in FIG. 3A.

FIGS. 3A and 3B shows a plasma display device according to an embodiment of the present invention.

As shown in the drawing, strips of first electrodes 31 are spaced apart from one another on the upper surface of a rear substrate 30. The first electrodes 31 are covered with a dielectric layer 32 formed on the upper surface of the rear substrate 30. The first electrodes 31 are address electrodes for inducing an addressing discharge. Partitions 40 formed in strips are spaced apart from one another on the upper surface of the dielectric layer 32 in a direction parallel to the first electrodes 31.

The partitions 40 define a discharge space and a fluorescent layer 50 consisting of R, G and B phosphors are formed in the discharge space.

A front substrate 60 is coupled above the partitions 40 to define the discharge space together with the partitions 40. Second electrodes 61 formed in strips as scanning electrodes and third electrodes 62 formed in strips as common electrodes are formed on the lower surface of the front substrate 60 to be perpendicular to the first electrodes 31. The second and third electrodes 61 and 62 are alternately arranged. A pair of second and third electrodes 61 and 62 are disposed at one pixel to bring about a sustaining discharge.

According to the present invention, the second and third electrodes 61 and 62 are made of a conductive metal, preferably aluminum (Al) or silver (Ag).

At least one auxiliary electrode 70 inducing an initial discharge with either the second electrode 61 or the third electrode 62 are formed on the lower surface of the front substrate 60.

The auxiliary electrode 70 is formed between the second electrode 61 and the third electrode 62, as shown in FIG. 3B, and is formed of a conductive metal such as Al or Ag.

The second and third electrodes 61 and 62 and the auxiliary electrode 70 are coated with the a dielectric layer 71 and a protective layer 72 may be formed on the lower surface of the dielectric layer 71.

The operation of the plasma display device constructed as described above will now be described. If predetermined voltages are applied to the first electrode 31 and the second electrode 61,. respectively, wall charges are formed along the surface of the dielectric layer 71. In such a state, an AC voltage is applied between the second electrode 61 and the third electrode 62 so that a sustaining discharge occurs.

The sustaining discharge occurring between the second electrode 61 as the scanning electrode and the third electrode 62 as the common electrode will now be described in more detail. An AC voltage, e.g., 180 V, is applied between the second electrode 61 and the third electrode 62 and a voltage equal to that of the third electrode 62 is applied to the auxiliary electrode 70. Then, an initial discharge occurs between the auxiliary electrode 70 and the second electrode 61 relatively close to each other. Here, since the width of the auxiliary electrode 70 is much smaller than that of the second or third electrode 61 or 62, the capacitance between the second electrode 61 and the auxiliary electrode 70 is small and thus the discharge time is very short.

In such a state in which charges are formed in the discharge space due to the initial discharge, a main discharge occurs between the second and third electrodes 61 and 62 due to the AC voltage. The charges and the ultraviolet rays formed during the initial discharge facilitate a dielectric breakdown of a discharge gas so that the main discharge readily occurs between the second and third electrodes 61 and 62. Since the capacitance between the second and third electrodes 61 and 62 is large and a discharge current therebetween is also larger than that during the initial discharge, a great deal of ultraviolet rays are generated to excite phosphors.

Figure 4:
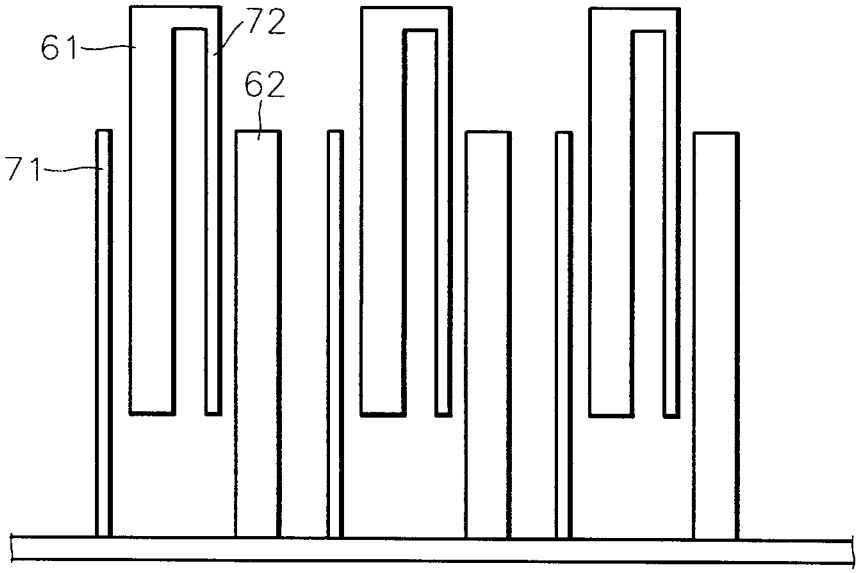
FIG. 4 is a plan view showing another example of the second and third electrodes and the auxiliary electrode.

According to the present invention, the auxiliary electrode 70 can be changed in various manners. For example, as shown in FIG. 4, the auxiliary electrode includes a first auxiliary electrode portion 71 adjacent to the second electrode 61 and a second auxiliary electrode portion 72 adjacent to the third electrode 62. Here, a voltage equal to that of the third electrode 62 is applied to the first auxiliary electrode portion 71, and a voltage equal to that of the second electrode 61 is applied to the second auxiliary electrode portion 72. However, the voltages applied to the first and second auxiliary electrode portions 71 and 72 are not limited to those in this embodiment and different voltages can be applied thereto depending on the discharge state.

Figure 5:
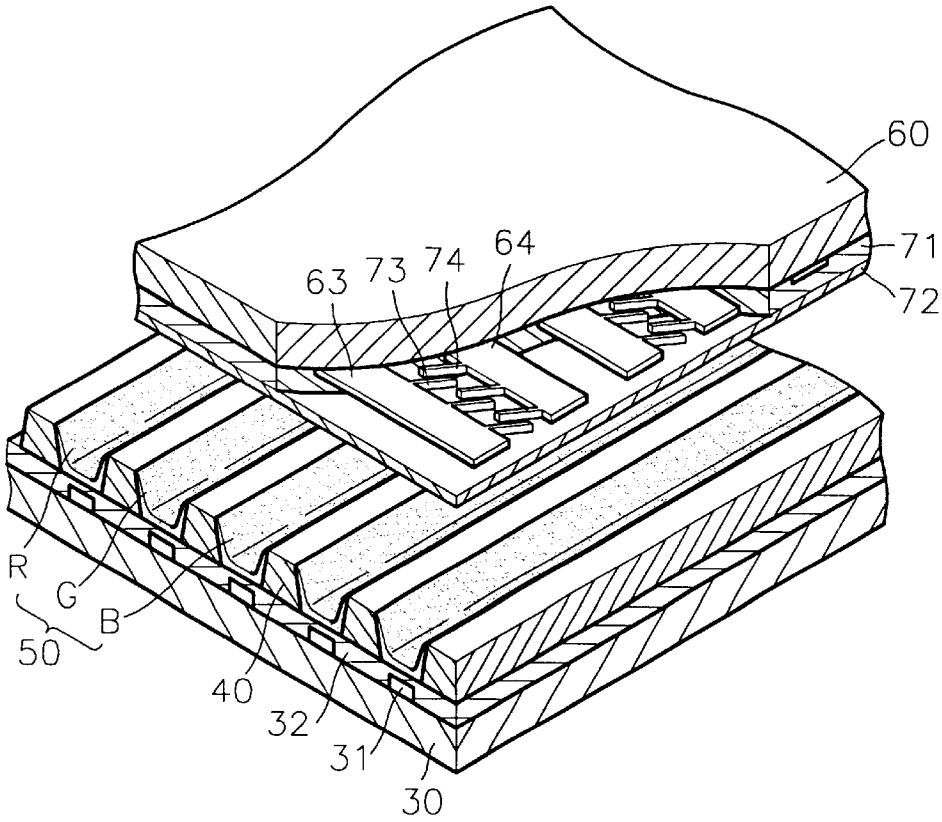
FIG. 5 is an exploded perspective view of a plasma display device according to another embodiment of the present invention.

FIG. 5 shows a plasma display device according to another embodiment of the present invention. Here, like reference numerals denote the same components as those in the previous drawings.

According to this embodiment, second and third electrodes 63 and 64 are formed on the lower surface of a front substrate 60 to be perpendicular to first electrodes 31. Auxiliary electrode portions 73 and 74 extending from the second and third electrodes 63 and 64 are positioned between the second and third electrodes 63 and 64. The auxiliary electrode portions 73 and 74 protrude and extend from the second and third electrodes 63 and 64 so as to be parallel to each other. Preferably, the auxiliary electrode portions 73 and 74 extend in a diagonal direction of the corresponding pixel, but are not limited as such. The second and third electrodes 63 and 64 and the auxiliary electrode portions 73 and 74 are formed of a conductive metal, as described above.

Figure 6:
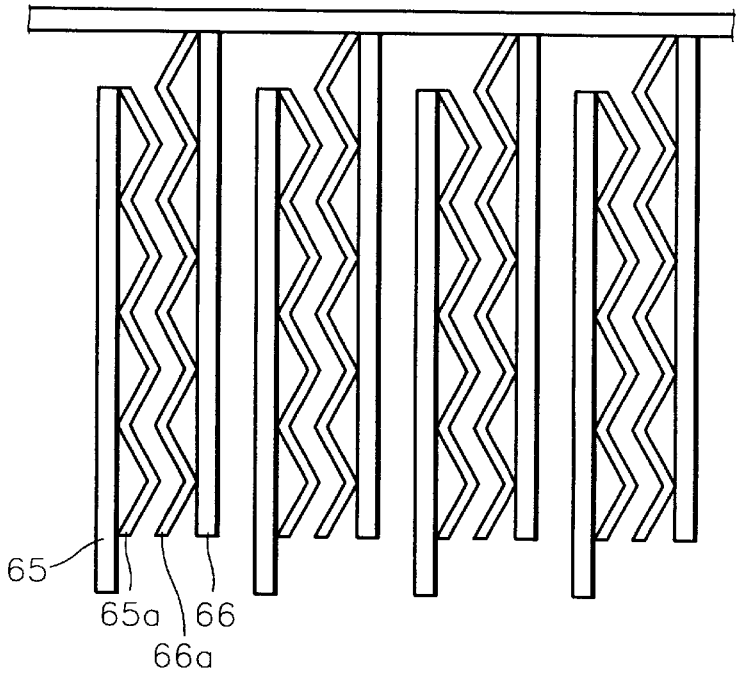
FIGS. 6 through 8 are plan views showing another examples of an auxiliary electrode portion employed in the plasma display device shown in FIG. 5.

FIG. 6 shows another example of the auxiliary electrode portions, in which the second and third electrodes 65 and 66 respectively have zigzagging auxiliary electrode portions 65*a* and 66*a*.

Figure 7:
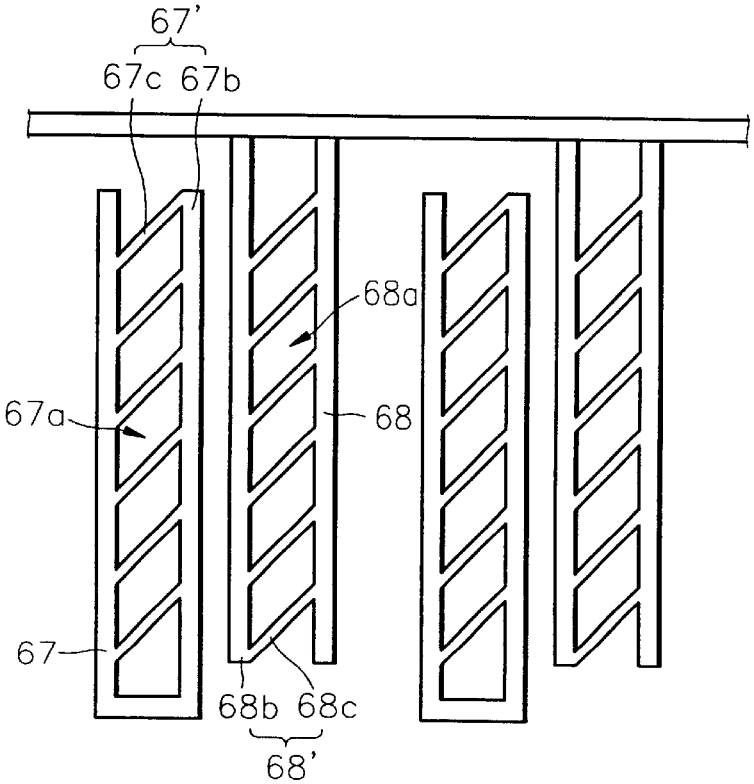

Referring to FIG. 7 showing still another extending auxiliary electrode portions, auxiliary electrode portions 67' and 68' includes a plurality of extending portions 67*c* and 68*c* which extend from the second and third electrodes 67 and 68, and body portions 67*d* and 68*d* parallel to the second and third electrodes 67 and 68 to connect the extending portions 67*c* and 68*c*, respectively. Thus, openings 67*a* and 68*a* are formed between the second and third electrodes 67 and 68 and the auxiliary electrode portions 67' and 68', respectively. Preferably, the openings 67*a* and 68*a* are parallelogram-shaped.

Figure 8:
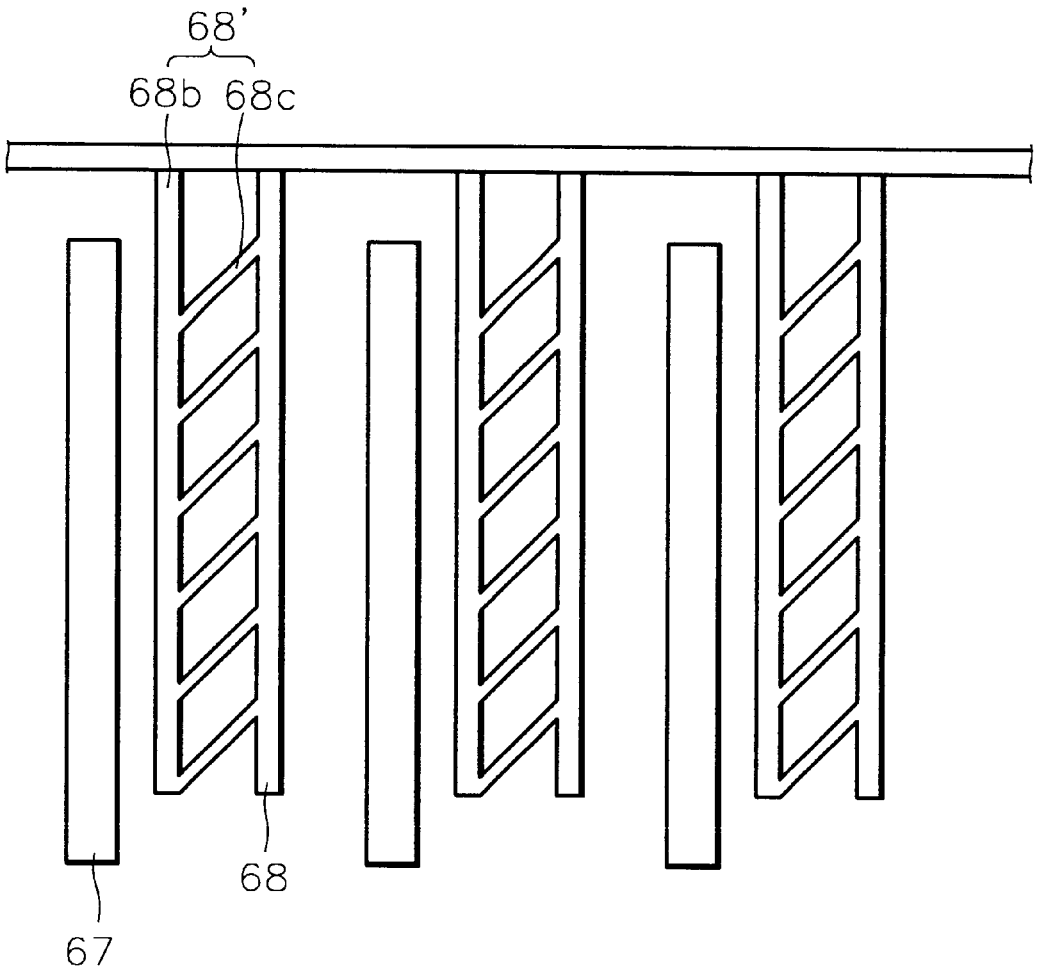

As shown in FIG. 8, an extending auxiliary electrode portion 68' may be provided in only one of the second and third electrodes 67 and 68.

In the operation of the plasma display panel having extending auxiliary electrode portions shown in FIGS. 5 through 8, an initial discharge occurs between neighboring auxiliary electrode portions for an extremely short time and a main discharge occurs between the second and third electrodes by the charges and ultraviolet rays generated at this time.

According to the plasma display device of the present invention, second and third electrodes provided on a front substrate are formed of a conductive metal, thereby obviating the need for transparent electrodes, unlike in the conventional art. Also, since electrodes are formed of a cheap metal, the fabrication cost involving formation of the electrodes can be reduced.

The present invention is not limited to the above-described embodiment but various changes and modifications may be effected by one skilled in the art within the scope of the invention as defined in the appended claims.

What is claimed is:

1. A plasma display device, comprising:

front and rear substrates disposed parallel to and facing each other;

a plurality of first electrodes formed in strips on the rear substrate;

a plurality of pairs of second and third electrodes formed alternately in metal strips on the front substrate at an angle to the first electrodes, each pair of said second and third electrodes and each of said first electrodes together defining a discharge cell at intersections thereof; and at least one auxiliary electrode formed adjacent to at least one of the second and third electrodes in at least one said discharge cell;

wherein said at least one auxiliary electrode is physically disconnected from both the second and third electrodes in said at least one discharge cell.

2. The plasma display device according to claim 1, wherein the at least one auxiliary electrode is formed of a conductive metal.

3. The plasma display device according to claim 2, wherein the at least one auxiliary electrode is formed between the second and third electrodes of the respective discharge cell, and a voltage equal to that of the third electrode is applied thereto.

4. The plasma display device according to claim 1, wherein the at least one auxiliary electrode includes a first auxiliary electrode portion adjacent to the second electrode and a second auxiliary electrode portion adjacent to the third electrode of the respective discharge cell, and a voltage equal to that of the third electrode is applied to the first auxiliary electrode portion and a voltage equal to that of the second electrode is applied to the second auxiliary electrode portion.

5. A plasma display device, comprising:

front and rear substrates disposed parallel to and facing each other;

a plurality of first electrodes formed in strips on the rear substrate;

a plurality of pairs of second and third electrodes formed in metal strips on the front substrate at an angle to the first electrodes, each pair of said second and third electrodes and each of said first electrodes together defining a discharge cell at intersections thereof;

wherein each said discharge cell includes at least one metal auxiliary electrode protrusion having a substantially uniform width and extending obliquely inwardly from at least one of the second and third electrodes of the discharge cell.

6. The plasma display device according to claim 5, wherein the auxiliary electrode protrusions extend in parallel from both the second and third electrodes.

7. The plasma display device according to claim 5, wherein the auxiliary electrode protrusions of a number of consecutive said discharge cells, which share the at least one of the second and third electrodes, are linked together in a saw tooth like line along the at least one of the second and third electrodes.

8. The plasma display device according to claim 5, wherein the auxiliary electrode protrusions of a number of consecutive said discharge cells, which share the at least one of the second and third electrodes, extendin parallel from one of the second and third electrodesand are linked at distal ends thereof by a bar extending parallel to the second and third electrodes, whereby a plurality of parallelogram shaped openings are formed between said one of second and third electrodes, the auxiliary electrode protrusions, and said bar.

9. The plasma display device according to claim 6, wherein the auxiliary electrode protrusions extend in a diagonal direction of the discharge cell.

10. The plasma display device according to claim 8 wherein widths of the auxiliary electrode protrusions extending from said one of the second and third electrodes and said bar are smaller than a width of the other of the second and third electrodes.

11. The plasma display device according to claim 1, wherein the at least one auxiliary electrode is formed in strips, and has a width smaller than that of the second and third electrodes.

12. A plasma display device, comprising:

front and rear substrates disposed parallel to and facing each other;

a plurality of first electrodes formed in strips on the rear substrate;

a plurality of pairs of second and third electrodes formed in metal strips on the front substrate at an angle to the first electrodes; and first and second auxiliary electrodes formed in strips parallel and adjacent to the second and third electrodes, respectively, wherein the first auxiliary electrodes are formed between the third and second electrodes of adjacent pairs while the second auxiliary electrodes are formed between the second and third electrodes of same pairs;

wherein the first auxiliary electrodes and the third electrodes are electrically commonly connected.

13. The plasma display device according to claim 12, wherein each said second electrode is electrically connected with one of said second auxiliary electrodes which is located between said second electrode and the corresponding third electrode.

14. The plasma display device according to claim 1, wherein the second and third electrodes are substantially perpendicular to the first electrodes.

15. The plasma display device according to claim 5, wherein the second and third electrodes are substantially perpendicular to the first electrodes.

16. The plasma display device according to claim 12, wherein the second and third electrodes are substantially perpendicular to the first electrodes.

17. The plasma display device according to claim 1, wherein said at least one auxiliary electrode is formed adjacent to and physically disconnected from said at least one of the second and third electrodes in at least two consecutive said discharge cells.

18. The plasma display device according to claim 8, wherein said bar extends continuously in at least two of said consecutive discharge cells.

19. The plasma display device according to claim 12, wherein widths of the first and second auxiliary electrodes are smaller than those of the second and third electrodes.

* * * * *